US007210382B2

(12) United States Patent
McCracken

(10) Patent No.: US 7,210,382 B2
(45) Date of Patent: May 1, 2007

(54) SCREW GUIDE DEVICE

(75) Inventor: Robert E. McCracken, Aiken, SC (US)

(73) Assignee: Eastway Fair Company Ltd., Tortola (VG)

( * ) Notice: Subject to any disclaimer, the term of this patent is extended or adjusted under 35 U.S.C. 154(b) by 0 days.

(21) Appl. No.: 11/204,548

(22) Filed: Aug. 15, 2005

(65) Prior Publication Data

US 2007/0034060 A1 Feb. 15, 2007

(51) Int. Cl.

| | |
|---|---|
| ***B25B 23/00*** | (2006.01) |
| *B25B 13/02* | (2006.01) |
| *B25B 23/16* | (2006.01) |
| *B25G 1/04* | (2006.01) |

(52) U.S. Cl. ..... 81/429; 81/125; 81/177.2

(58) Field of Classification Search ..... 81/429, 81/125, 177.2, 451

See application file for complete search history.

(56) References Cited

U.S. PATENT DOCUMENTS

| | | | | |
|---|---|---|---|---|
| 569,896 | A | | 10/1896 | Van Cauwenberg |
| 2,940,488 | A | | 6/1960 | Riley, Jr. |
| 3,056,441 | A | | 10/1962 | Helms |
| 4,237,946 | A | * | 12/1980 | Leitner ..... 81/429 |
| 4,736,658 | A | | 4/1988 | Jore |
| 4,877,359 | A | | 10/1989 | Kolacek |
| 5,012,708 | A | | 5/1991 | Martindell |
| 5,101,698 | A | | 4/1992 | Paradiso |
| 5,182,973 | A | | 2/1993 | Martindell |
| 5,309,799 | A | | 5/1994 | Jore |
| 5,382,120 | A | | 1/1995 | Parsons |
| 5,470,180 | A | | 11/1995 | Jore |
| 5,682,800 | A | | 11/1997 | Jore |
| 5,779,404 | A | | 7/1998 | Jore |
| 5,882,151 | A | | 3/1999 | Wirth, Jr. et al. |
| 5,954,463 | A | | 9/1999 | Jore |
| 6,148,699 | A | * | 11/2000 | Han ..... 81/451 |
| 6,176,654 | B1 | | 1/2001 | Jore |
| 6,543,959 | B1 | | 4/2003 | Jore |
| 6,722,667 | B2 | | 4/2004 | Cantlon |
| 6,739,872 | B1 | | 5/2004 | Turri |
| 2004/0218988 | A1 | | 11/2004 | Cantlon |
| 2005/0025592 | A1 | | 2/2005 | Cantlon |

OTHER PUBLICATIONS

Craftsman Speed-Lok Magnetic Adjustable Screw Setter # 926204 (3pgs) Sep. 2000.

* cited by examiner

*Primary Examiner*—Lee D. Wilson
*Assistant Examiner*—Alvin J. Grant
(74) *Attorney, Agent, or Firm*—Brinks Hofer Gilson & Lione

(57) ABSTRACT

Screw guide is provided and includes a cylindrical member having a first end adapted to rotate a fastener and a second end adapted to receive torque from an external source and transfer the torque to the fastener, a stop ring engaged with the cylindrical member that is adjustable to control the movement of the fastener with respect to the screw guide. The screw guide may also include a sleeve that surrounds the cylindrical member and the stop ring and a stand off ring that is engaged with the cylindrical member.

20 Claims, 2 Drawing Sheets

SCREW GUIDE DEVICE

BACKGROUND OF THE INVENTION

The present invention is directed to devices to aid in the insertion of fasteners into materials.

It is often desirable to insert a fastener, such as a screw, a known or predetermined depth into a material. Inserting the screw a known depth into a material can be a critical evolution when it is important to avoid inserting the screw too deep into a material, i.e. to avoid the screw from extending through the opposite side of the material when it is thinner than the length of the screw, or to avoid inserting the screw too deep in the material to prevent the material from fracturing if the material is brittle and the screw extends through a majority of the depth of the material. Additionally, it is often desirable to insert a screw into a material such that the screw head does not contact the material surface that the screw is extended into, i.e. when the screw head is at a "stand off height" from the material surface. In addition to inserting a screw into a material with a stand off height it is often critical that multiple screws of the same length be inserted into a material with each having the same stand off height above the material surface.

It is desirable to provide a screw guide device with an improved design to insert a screw a predetermined depth into a material and provide a mechanism to establish a repeatable screw head stand off height.

SUMMARY

Accordingly, a screw guide device is provided to insert screws a set depth into a material and to establish a predetermined and repeatable stand off height. In general, the screw guide device of the present invention contains a cylindrical member with a first and a second end that is rotatably engaged with a stop ring. A sleeve surrounds the cylindrical member and the stop ring. A stand off ring is engaged with the cylindrical member between the sleeve and a second end of the cylindrical member. The cylindrical member is adapted to receive the torque from an external source on the second end of the cylindrical member and transfer the torque to a screw that can be engaged by the first end of the cylindrical member. As torque is applied to the cylindrical member, the sleeve translates along the longitudinal axis of the cylindrical member until it contacts the stand off ring, which prevents further insertion of the screw.

A method for setting screw head stand off height is provided. Before using the screw guide device, the user adjusts the initial position of the sleeve with the stop ring to position it to the length of the screw to be used and also adjusts the stand off ring to set a stand off height of the screw. The user engages an external device to provide torque to the cylindrical member to drive the screw. The cylindrical member will drive the screw the preset distance and establish the preset stand off height based on the position of the stand off ring. After use, the sleeve slides towards the working portion of the tool until it contacts the forward stop ring that is preset to accommodate the length of the screw to be used. This allows the user to insert into the material another screw of the same length into the material and establish the same stand off height.

DETAILED DESCRIPTION OF THE INVENTION

Figures 1, 4:
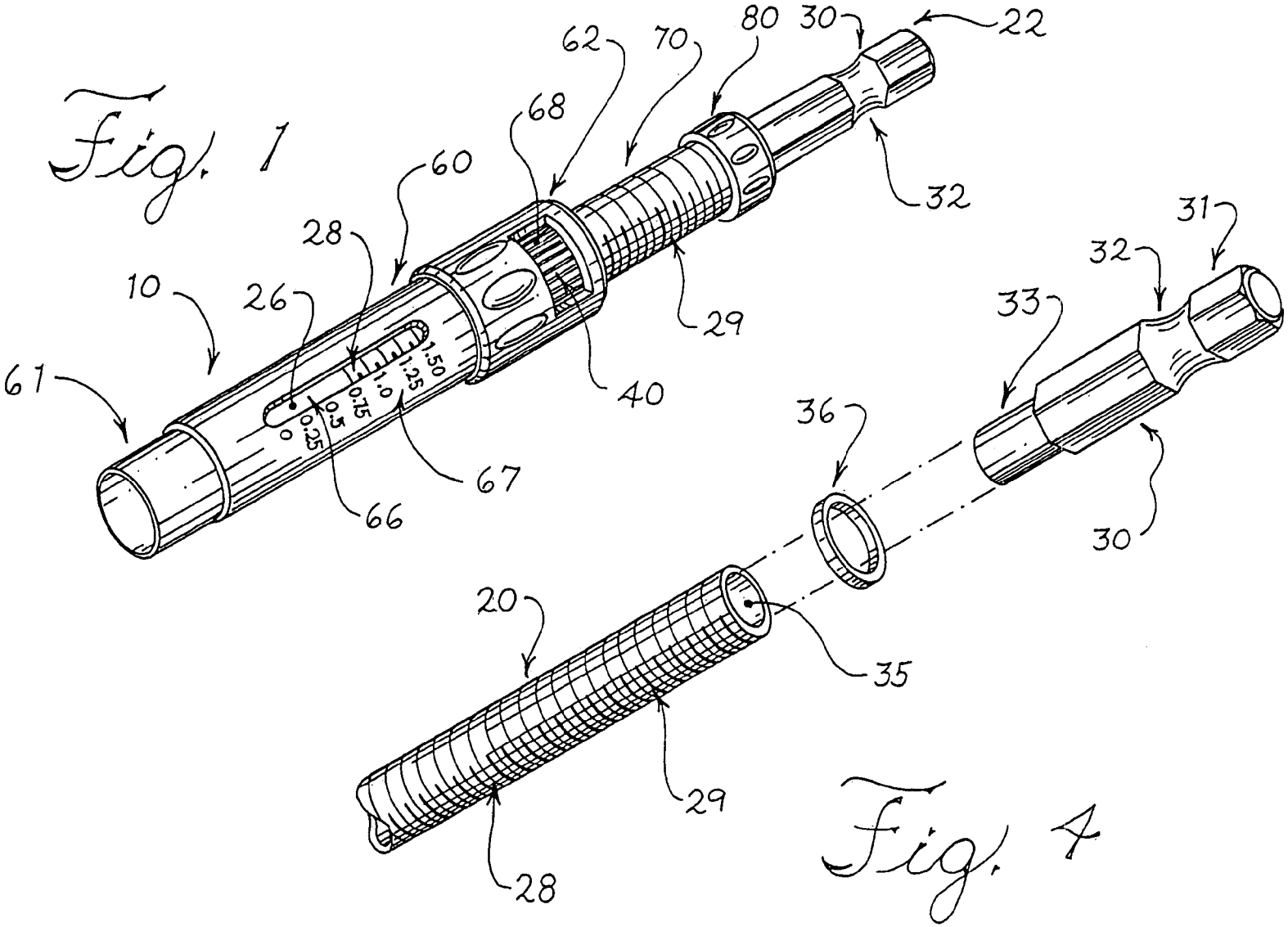
FIG. 1 is a perspective view of one embodiment of the screw guide device of the present invention.
FIG. 4 is an exploded view of the components used to form the cylindrical member of the screw guide device of FIG. 1.
Figure 2:
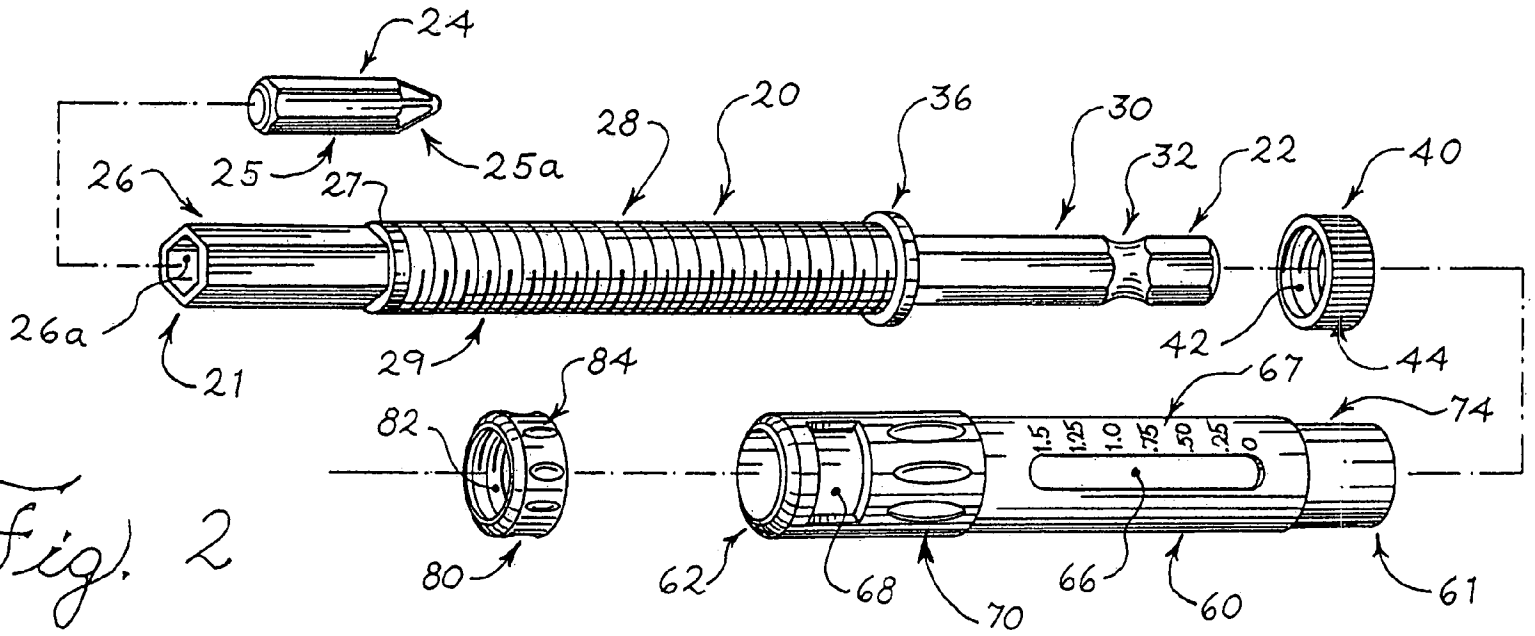
FIG. 2 is an exploded view of the device of FIG. 1.
Figure 3:
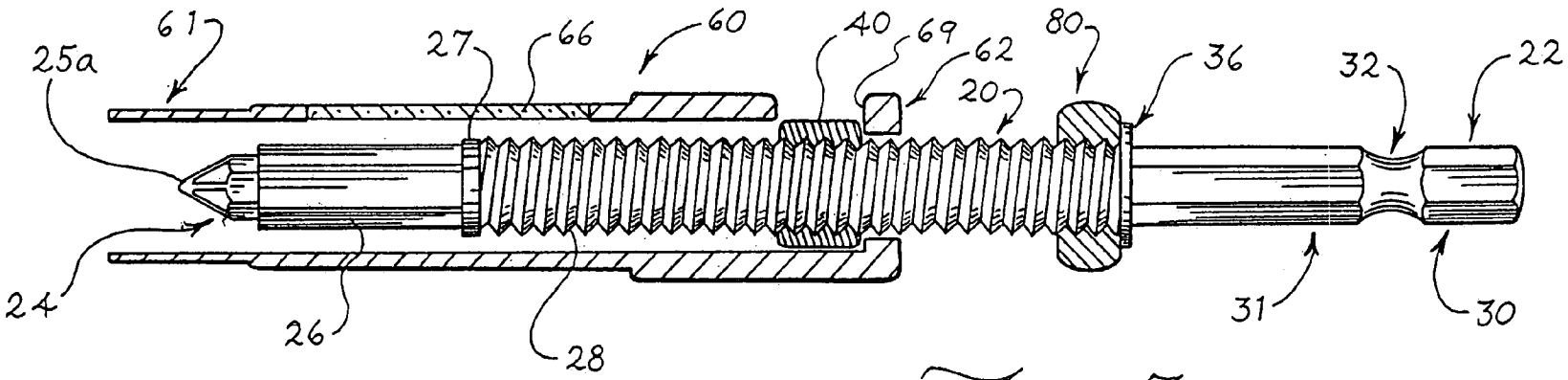
FIG. 3 is a cross-sectional view of the device of FIG. 1.

As shown in FIGS. 1–3, a screw guide 10 used to insert a standard screw (not shown) to a specific screw depth and set a standard screw head "stand off" height from a work surface (not shown) is provided. The embodiments contained herein specifically describe and illustrate the use of the screw guide 10 in combination with a screw, but the screw guide 10 may also be fitted for use with other types of fasteners such as bolts that are driven into a material by rotating them with sufficient torque. In addition, for ease of reference in the following description, the fastener will be referred to as a screw. This reference is not meant to limit the scope of the invention.

The screw guide 10 contains a cylindrical member 20 that is adapted to receive torque produced by an external source (not shown) and to transmit the torque to a screw or other type of fastener using a machined removable tip 24. The cylindrical member 20 is preferably made from steel. The cylindrical member 20 has a first end 21, a second end 22, and a threaded section 28 disposed between them. The screw guide also contains a stop ring 40 that travels along the threaded section 28 of the cylindrical member, a sleeve 60 that surrounds the stop ring, and a stand off ring 80 that also travels along the threaded section 28 of the cylindrical member and is located between the sleeve 60 and the second end 22 of the cylindrical member.

A working portion 25*a* of the removable tip 24 is formed in the shape opposite of the torque receiving structure, i.e., the fastener, and is similar to tips that are used with electric drills or screwdrivers that are known in the art. Although a removable tip 24 for use with a Phillips head screw is shown in the figures, removable tips 24 for use with flat head screws, or other types fasteners, such as bolts can be used. The removable tip 24 for use with the screw guide 10 may be made from a ferromagnetic material, as is known.

As best shown in FIG. 3, the removable tip 24 is inserted into the front section 26 of the cylindrical member 20. The front section 26 includes an aperture 26*a* at the front end 21 of the cylindrical member that is hollow and has an internal diameter to allow the removable tip 24 to fit snuggly within the front section 26. The front section 26 has the same general length as the shaft portion 25 of the removable tip 24. As a result, the working portion 25*a* of the removable tip 24 extends outside of or beyond the front section 26 to allow the working portion 25*a* to engage the screw head.

A magnet 27 may be provided at the rear portion of the front section 26 to help maintain the removable tip 24 inserted into the front section 26, but to allow the user to extract the removable tip 24 from the cylindrical member 20 when desired. In one embodiment, the front section 26 is formed with a hexagonal profile to maintain a tight fit between the front section and removable tips 24 that have a hexagonal shaped shaft portion 25. In other preferred embodiments, the internal surface of the front section 26 may be round or some other suitable shape.

A threaded section 28 with external threads 29 is between the front section 26 and the shank 30. The length of the threaded section 28 must be at least as long as the length of the longest screw that the screw device 10 is designed to used with in addition to the combined widths of the stop ring 40 and the stand off ring 80.

Further along the cylindrical member 20 there is a blind hole 35 on the end of the threaded section 28 closest to the second end 22 of the cylindrical member as is shown in FIG. 4. The blind hole 35 is sized to receive a post 33 from a shank 30 that forms the second end 22 of the cylindrical member 20 when it is mated with the rest of the cylindrical member 20. A stop washer 36 is located on the post 33 when the post 33 is inserted into the blind hole 35. The stop washer 36 serves to maintain the post 33 inserted into the blind hole 35, and, in a preferred embodiment, sets the default position of the stand off ring 80, as will be discussed below. Alternatively, the cylindrical member 20 can be fashioned from a single piece.

The shank 30 is sized and shaped to be inserted into the chuck of a drill (not shown) or other tool to transfer torque to the cylindrical member 20 that rotates along with the chuck when so engaged. In the preferred embodiment shown in FIG. 1, the shank 30 contains a rear polygonal section 31 to allow the chuck to rotatably hold the cylindrical member 20 as well as a recess element 32 designed to be engaged by detent balls (not shown) in a quick release chuck (not shown) for rotatably holding the cylindrical member 20 in a quick release drill chuck.

As best shown in FIG. 3, the screw guide device also includes a hollow stop ring 40 with internal threads 42 corresponding to the external threads 29 of the cylindrical member 20. The stop ring 40 is preferably made from nylon but other types of plastic or metals such as steel or brass can be used. The stop ring 40 has a surface wide enough for the user to rotate it with respect to the cylindrical member 20, and additionally is wide enough to have a sufficient number of internal threads 42 to provide a durable rotational connection between the stop ring 40 and the external threads 29 of the cylindrical member 20. The outer surface 41 of the stop ring 40 is formed with a straight knurl 44 to provide the user with a surface that can be rotated against the frictional forces that will oppose rotation of the stop ring 40.

A sleeve 60 surrounds most of the longitudinal length of the cylindrical member 20. The sleeve may be made from steel or brass with a nylon overmold, but other materials with acceptable characteristics can be used. The sleeve 60 has a tip end 61 that is closest to the removable tip 24 of the cylindrical member 20 when the sleeve 60 surrounds the cylindrical member 20 and a chuck end 62 that is closest to the second end 22. The sleeve 60 is a long hollow tube with an inside diameter slightly larger than the outside diameter of the stop ring 40 to allow for easy movement along the longitudinal axis of the cylindrical member 20, but a close enough fit to minimize the size of foreign objects or particles that can get between the sleeve 60 and the cylindrical member 20.

The sleeve 60 contains an aperture 68 in the grip section 70 near the chuck end 62. The aperture 68 is slightly wider than the width of the stop ring 40. The chuck end 62 of the sleeve 60 contains an inner diameter slightly smaller than the outer diameter of the stop ring 40 such that the stop ring 40 creates a barrier from the sleeve 60 moving any further towards the first end 21 of the cylindrical member 20 than the position where the chuck end 62 of the sleeve makes contact with the stop ring 40.

As shown in FIGS. 1 and 2, the sleeve 60 also includes a longitudinal slot 66 along the longitudinal axis of the sleeve 60 between the aperture 8 and the tip end 61 of the sleeve. The slot 66 allows the viewer to view the cylindrical member 20 as the sleeve 60 translates along the longitudinal axis of the cylindrical member 20. The slot 68 may include a translucent cover to prevent entry of foreign materials or particles into the screw guide 10. The sleeve 60 also includes depth markings 67 (a scale) that are calibrated to allow the user to set the screw guide 10 for the length of screw to be used with the screw guide 10.

The slot 66 is calibrated in the following manner. The user holds the sleeve 60 such that the ledge 69 of the sleeve 60 contacts the stop ring 40. The user views the slot 66 and rotates the stop ring 40 until the edge between the front section 26 and the threaded section 28 corresponds to the depth marking 67 equal to the length of the screw to be used. The calibration of the depth markings 67 correspond to the distance from the chuck end 62 of the sleeve 60 to the stand off ring 80 in the default position at each position of the edge between the front section 26 and the threaded section 28. Of course, two or more sets of depth markings 67 may be provided. For example, where two depth markings 67 are provided, one may indicate metric units and the other may indicate English units. In an alternate embodiment, the sleeve 60 can include two slots 66 each with different depth markings.

To permit a fastener to have a stand off from the material in which it is engaged with, a stand off ring 80 is provided. The stand off ring 80 is hollow with internal threads that correspond to the external threads 29 of the cylindrical member 20. The stand off ring 80 is located between the sleeve 60 and the shank 30, specifically the stand off ring 80 may contact the stop washer 36 between the threaded section 28 and the shank 30. In the preferred embodiment, shown in FIG. 1, the stand off ring 80 can be rotatably translated to a position at the extreme end of the threaded section 28 (closest to the shank 30) where the height adjustment ring contacts the stop washer 36 on the cylindrical member 20. The stand off ring 80 is in the default position when it abuts the stop washer 36. The stand off ring 80 may be rotated such that it translates away from the stop washer 36 and towards the sleeve 60 along the longitudinal axis of the cylindrical member 20.

In operation, the screw guide 10 is preferably set for use with a screw in the following manner. Initially, the screw guide 10 is set to the length of the screw that will be driven by the screw guide 10. To set the length, the stop ring 40 is rotated by the user, which will translate the stop ring 40 along the length of the cylindrical member 20. While operating the stop ring 40, the user holds the sleeve 60 so that the ledge 69 of the chuck end 62 abuts against the stop ring 40. The sleeve 60 is aligned over the stop ring 40, so that the stop ring aperture 68 is positioned over the stop ring 40 to allow the user to rotate the stop ring 40. As the sleeve 60 translates along the cylindrical member 20, the user views the slot 66 and adjusts the stop ring 40 to position the edge between the front section 26 and the threaded section 28 to the position corresponding to the depth marking 67 of the screw height to be used. The length of the slot 66 and the position of the depth markings 67 along the slot 66 can be dimensioned according to the range of screw lengths that are intended to be used with the screw guide 10. When the height adjusting ring 80 is in its default position, i.e. backed out as far as possible towards the end of the threaded section 28 closest to the second end 22 of the cylindrical member, the distance between the chuck end 62 of the sleeve 60 and the stand off ring 80 corresponds to the position of the edge between the front section 26 and the threaded section 28, as calibrated by the depth markings 67.

The stand off height of the screw head above the surface of the material into which the screw is inserted can also be set using the screw guide 10. As was discussed above, the stand off ring 80 is normally positioned with respect to the cylindrical member 20 such that the stand off ring 80 is located at the default position at the end of the threaded section 28 closest to the second end 22 of the cylindrical member 20. If the user desires to set a screw stand off height the user pulls the sleeve 60 towards the stand off ring 80 to force the sleeve 60 to contact the stand off ring 80. The user then rotates the stand off ring 80 about the cylindrical member 20 a sufficient number of turns to move the stand off ring 80 such that the sleeve moves toward the first end 21 of the cylindrical member 20 until the edge between the front section 26 and the threaded section 28 corresponds to the desired stand off height as read by the depth markings next to the slot 66. The stand off height will be repeatable as long as the user maintains the stand off ring 80 at a constant position with respect to the cylindrical member when inserting the screws into the material, and the user continues to use screws with the same length.

In operation, the screw guide 10 is operated as follows. After the device 10 is adjusted for the appropriate screw length and a desired screw head stand off height is set, if any, the user inserts shank 30 into the chuck of a drill or any other tool that has sufficient torque to rotate the screw guide 10 in the presence of sufficient downward force to insert a screw into the material.

After the shank 30 is rotatably engaged in the chuck of the drill, a screw is presented to the removable tip 24 such that the extending structure for the removable tip 24 engages the screw head. When the screw is engaged with the removable tip 24, the user sets the screw in the desired position and then applies torque to the shank 30 of the cylindrical member 20, which rotates the cylindrical member 20 along with the rotation of the chuck. When the screw is being inserted, the user holds the sleeve 60 so that the tip end 61 of the sleeve 60 is flush with the work surface. Additionally, as the screw is being inserted, the cylindrical section 20 moves closer to the work surface, therefore the stand off ring 80 moves closer to the chuck end 62 of the sleeve 60. Eventually, the stand off ring 80 contacts the sleeve 60, which prohibits the depth guide 10 from driving the screw further into the work surface.

The screw guide 10 may be used again to drive another screw into the material. Assuming the user desires to drive the same size screw with the same set off height, the user simply removes the screw guide 10 from the work surface and allows the sleeve 60 to move towards the first end 21 of the cylindrical member until the ledge 69 of the sleeve 60 makes contact with the stop ring 40. The user may drive another screw into a work surface using the procedure described above. Alternatively, if the user wishes to use a different sized screw or achieve a different stand off height, the user should adjust the screw guide 10 for the desired screw size or stand off height as described above, then insert the screw into the work surface.

While the preferred embodiments of the invention have been described, it should be understood that the invention is not so limited and modifications may be made without departing from the scope of the invention. The scope of the invention is defined by the appended claims, and all devices that come within the meaning of the claims, either literally or by equivalence, are intended to be embraced therein.

What is claimed:

1. A screw guide comprising:

a cylindrical member having a first and a second end and a threaded portion such that the first end is adapted to rotate a fastener in contact with the first end and the second end is adapted to receive torque and transfer the torque to the fastener in contact with the first end;

a sleeve having a first and a second end surrounding the cylindrical member;

an adjustable stop ring engaged with the threaded portion of the cylindrical member to limit the movement of the sleeve with respect to the screw guide wherein the sleeve surrounds the stop ring; and a stand off ring engaged with the threaded portion of the cylindrical member and positioned between the second end of the sleeve and the second end of the cylindrical member wherein the stand off ring additionally limits the movement of the sleeve.

2. The screw guide of claim 1 wherein the cylindrical member further comprises external threads.

3. The screw guide of claim 2 wherein the stop ring further comprises internal threads corresponding to the external threads of the cylindrical member.

4. The screw guide of claim 3 wherein the sleeve contains an aperture to expose a portion of the stop ring.

5. The screw guide of claim 4 wherein the rotation of the stop ring causes the sleeve to translate along a longitudinal axis of the cylindrical member.

6. The screw guide of claim 1 wherein the stand off ring can be rotated to adjust the stand off height of the fastener.

7. The screw guide of claim 1 wherein the sleeve has a slot to expose the position of the cylindrical member with respect to the sleeve.

8. The screw guide of claim 7 wherein the slot has a transparent cover.

9. The screw guide of claim 7 wherein the sleeve has an indicator along the slot to allow a specific fastener depth to be set.

10. The screw guide of claim 7 wherein the sleeve has an indicator along the slot to allow a specific fastener length to be set.

11. An apparatus for setting the stand off of a screw head comprising:

a cylindrical member with a first end adapted to engage and rotate a screw head and a second end adapted to receive torque produced by an external source;

a stop ring rotatably surrounding the cylindrical member;

a sleeve surrounding the cylindrical member and the stop ring, wherein the sleeve contains an aperture to expose a portion of the stop ring for manipulation of the stop ring; and a stand off ring engaged with the cylindrical member to limit the travel of the sleeve along the cylindrical member.

12. The apparatus of claim 11 wherein the stop ring and the sleeve are configured to translate the sleeve along a longitudinal axis of the cylindrical member with rotation of the stop ring.

13. The apparatus of claim 12 wherein the cylindrical member contains external threads and the stop ring contains corresponding internal threads.

14. The apparatus of claim 13 wherein the stand off ring contains internal threads corresponding to the external threads of the cylindrical member.

15. The apparatus of claim 11 wherein the sleeve further comprises a slot along the sleeve to expose the position of the cylindrical member with respect to the sleeve.

16. The apparatus of claim 15 wherein the sleeve further comprises a scale along the slot to allow a specific fastener depth to be set.

17. A method for setting a screw head stand off height comprising:

providing a cylindrical member with a first end and a second end, the cylindrical member being adapted to receive a stop ring and a stand off ring around the circumference of the cylindrical member and a hollow sleeve surround the cylindrical member and at least a portion of the stop ring;

adjusting the position of the sleeve with respect to the first end of the cylindrical member;

positioning the first end of the cylindrical member to engage a rotatable fastener to insert the fastener through a surface;

providing a source of torque to the second end of the cylindrical member; and applying the torque to rotate the fastener a specified distance based on the position of the stand off ring with respect to the cylindrical member.

18. The method of claim 17 wherein the step of adjusting the position of the sleeve with respect to the first end of the cylindrical member further comprises the step of rotating the stop ring to adjust the position of the sleeve.

19. The method of claim 18 further comprising the step of adjusting the position of the stand off ring rotatably disposed on the cylindrical member to adjust a stand off height of the fastener.

20. A screw guide comprising:

a cylindrical member having a first and a second end and a threaded portion such that the first end is adapted to rotate a fastener in contact with the first end and the second end is adapted to receive torque and transfer the torque to the fastener in contact with the first end;

a sleeve having a first and a second end surrounding the cylindrical member and an aperture;

an adjustable stop ring with internal threads that engage the threaded portion of the cylindrical member to limit the movement of the sleeve with respect to the screw guide wherein the sleeve surrounds the stop ring, with a portion of the stop ring being exposed through the aperture, wherein rotation of the stop ring causes the sleeve to translate along a longitudinal axis of the cylindrical member to allow the sleeve to accommodate a specific screw length;

a stand off ring engaged with the threaded portion of the cylindrical member and positioned between the second end of the sleeve and the second end of the cylindrical member, wherein the stand off ring additionally limits the movement of the sleeve.

* * * * *